United States Patent [19]

Robbins

[11] 4,136,788

[45] Jan. 30, 1979

[54] DUNNAGE BAG END CLOSURE

[75] Inventor: James A. Robbins, Covington, Tenn.

[73] Assignee: Signode Corporation, Glenview, Ill.

[21] Appl. No.: 783,675

[22] Filed: Apr. 1, 1977

[51] Int. Cl.[2] ..... B65G 1/14; B65D 57/00

[52] U.S. Cl. ..... 214/10.5 D; 206/522; 229/55

[58] Field of Search ..... 214/10.5 D; 105/468; 229/55, 62.5; 206/522, 814

[56] References Cited

U.S. PATENT DOCUMENTS

| | | | |
|---|---|---|---|
| 3,506,143 | 4/1970 | Evans | 214/10.5 D |
| 3,808,981 | 5/1974 | Shaw | 105/468 |

*Primary Examiner*—Francis S. Husar
*Assistant Examiner*—George F. Abraham
*Attorney, Agent, or Firm*—Dressler, Goldsmith, Clement, Gordon & Shore, Ltd.

[57] ABSTRACT

A multi-ply dunnage bag is provided with an end closure which is both strong and easy to fabricate. The first wall of the dunnage bag has, at one end, an extension or flap on the end of each ply. The flaps on each ply of the first wall are segregated into pairs of adjacent flaps and the two flaps that make up each pair are secured together and folded over the end of the bag where they are inserted between two adjacent plies of the opposite, or second wall and wherein at least one of the flaps of each pair is secured to one of the plies of the second wall. An identical end closure is provided at the other end of the bag, but with the plies of the second wall having flaps folded over and secured to the first wall.

2 Claims, 5 Drawing Figures

2.
12
52
50
48
9
16
3.
10
2.
3.

12
52
50
9
18
16
10

16
22
21
14
18
22a
21'
22'
22a
60
62
54
22a 16
18
24
23
24a
22
21
14
23'
24'
24a
21'
22'
60
60
60
62
54
24a 16
18
26
25
26a
24
23
22
21
14
21'
22'
23'
25'
26'
24'
26a
60
60
60
62
54
26a

DUNNAGE BAG END CLOSURE

BACKGROUND OF THE INVENTION

This invention relates to dunnage bags for use in shipment of freight by rail, ship, truck, aircraft, and the like, and more particularly, to an inflatable, disposable dunnage bag for such use. Typically, such dunnage bags have a gastight bladder (usually polyethylene) surrounded by an outer protective and supportive shroud consisting of a number of plies of heavy paper.

The inflatable, disposable dunnage bags are used in freight carriers where it is customary to fill the spaces between the cargo or between the cargo and walls of the freight carrier to prevent the cargo from shifting and damaging either the cargo itself and/or the walls of the freight carrier. Inflatable, disposable dunnage bags are placed between the cargo in a deflated condition and are subsequently inflated with high pressure air to a certain design pressure, usually between 2 and 6 pounds per square inch, depending on the size and wall structure of the particular bag.

Experience with this type of dunnage bag has revealed that the multi-ply paper shroud structure must function to support the inflated bladder under conditions of inflation and shock loading. Obviously, the end closures of the bag must be made strong enough to prevent their failure under these conditions. To this end, a number of end fold closure designs have been proposed and tried in the past.

Typical of recent end closure designs for dunnage bags are those described in the U.S. Pats. to Ludlow, No. 3,365,116; to Hollis, No. 3,556,318; to Evans, No. Re. 27,787; to Shaw No. 3,808,981; and to Baxter, No. 3,955,690. The end closures illustrated in all of these patents involve the use of flaps on the plies of one wall which are folded over the end of the bag and then placed between certain plies of the opposite wall of the dunnage bag. Certain of these folded flaps are then secured to each other and/or adjacent plies of the wall into which they have been inserted.

Fabrication of such a dunnage bag necessarily requires a number of steps to fold over the flaps, in the proper sequence, and secure them (as with adhesive) to specific adjacent flaps of plies of the wall into which they are inserted.

In order that a multi-ply dunnage bag can be fabricated efficiently and hence, less expensively, it would be desirable to incorporate an end closure arrangement which would be relatively simple to fabricate, preferably one in which only a relatively small number of steps are required to form the completed end closure. However, such an arrangement must also provide for strong end closure joints having a fairly even distribution of stress throughout the end closure assembly.

SUMMARY OF THE INVENTION

The end closure of the instant invention has a unique structure which (1) incorporates, for a majority of the plies, secured joints between the folded-over flaps of plies of one wall and plies of the other wall; (2) provides a fairly uniform joint stress distribution over the thickness of the end closure; and (3) segregates the closure flaps into pairs of adjacent flaps so that each pair of flaps may be adhesively coated, folded over, and secured to the plies on the opposite walls—as a pair in a single process step rather than requiring the folding and gluing of the flaps singly, one at a time.

Numerous other advantages and features of the present invention will become readily apparent from the following detailed description of the invention and embodiments thereof, from the claims and from the accompanying drawings in which each and every detail shown is fully and completely disclosed as a part of this application.

BRIEF DESCRIPTION OF THE DRAWINGS

In the accompanying drawings forming part of the specification, and in which like numerals are employed to designate like parts throughout the same.

DESCRIPTION OF THE PREFERRED EMBODIMENTS

Figure 1:
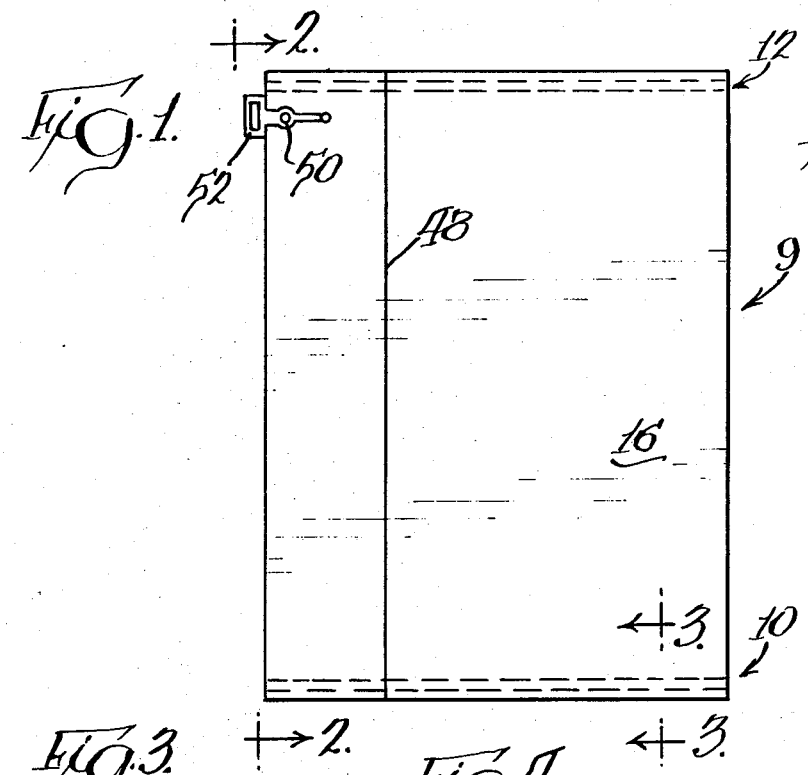
FIG. 1 is a front elevational view of a dunnage bag incorporating the end closure of the present invention.

While this invention is susceptible of embodiment in many different forms, there are shown in the drawings and will herein be described in detail preferred embodiments of the invention. It should be understood, however, that the present disclosure is to be considered as an exemplification of the principles of the invention and is not intended to limit the invention to the embodiments illustrated.

Referring to the drawings, there is indicated in FIG. 1 a bag having the end closures of this invention with such end closures being generally designated 10 and 12. The bag is a multi-ply bag, and is made of a plurality of plies of paper, such as Kraft paper, which form an outer shroud around a heat sealable inner, thermoplastic, film-like liner or bladder 14 (illustrated in FIGS. 3 through 5). The dunnage bag has two major side surfaces or walls which lie generally opposite each other and are substantially parallel to each other. To aid in describing the end closure construction hereinafter, one of these walls is designated as the first wall 16 and the other wall is designated as the opposite, or second wall 18.

Figure 3:
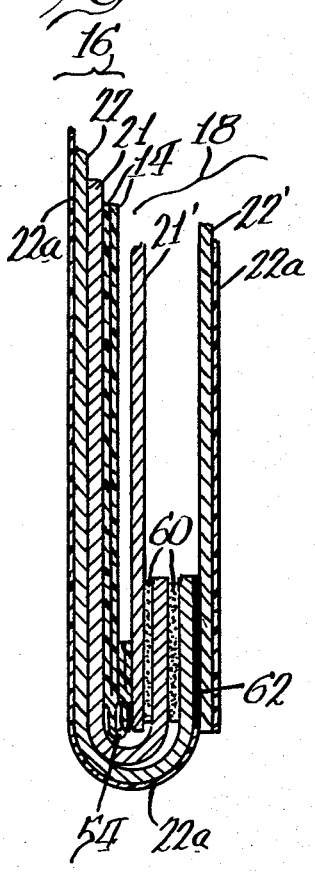
FIG. 3 is a partial cross-sectional view of the end closure of the present invention for a 2-ply dunnage bag taken generally along the plane 3—3 of FIG. 1.
Figure 4:
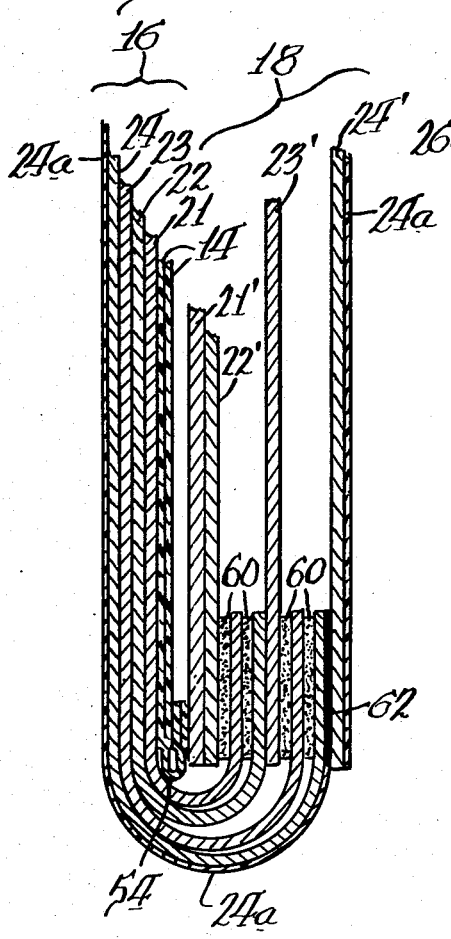
FIG. 4 is a cross-sectional view of the end closure of the present invention similar to FIG. 3 but showing a 4-ply bag instead of a 2-ply bag.
Figure 5:
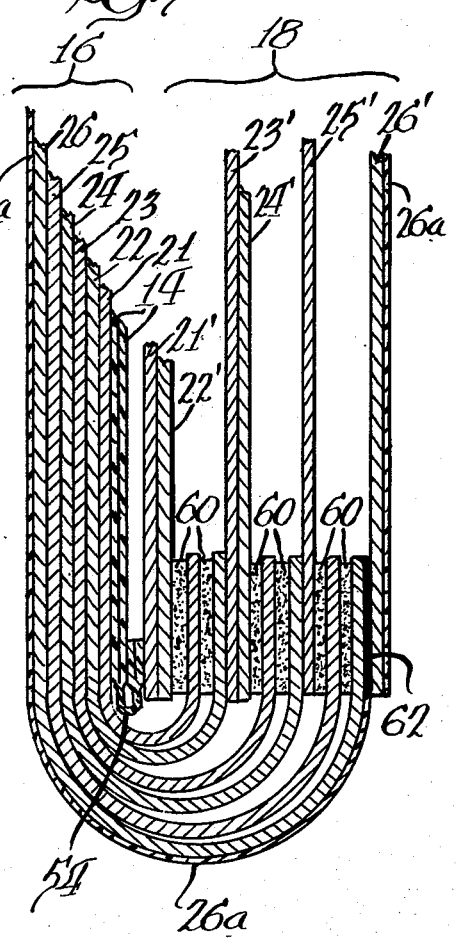
FIG. 5 is a view similar to FIG. 3 showing the end closure of the present invention but for a 6-ply bag instead of a 2-ply bag.

The individual sheets or plies that form the outer shroud that encases or envelops the bladder 14 are illustrated for a 2, 4 and 6-ply bladder in FIGS. 3, 4, and 5, respectively. For the 2-ply bladder illustrated in FIG. 3, the first wall 16 is comprised of an innermost or first ply 21 and an outer, or second ply 22. The corresponding plies in the opposite, or second wall 18 are designated 21' and 22'. The second or outer ply preferably has a polyethylene coating **22(*a*)** to provide a moisture impervious barrier for protection of the paper plies.

Referring now to FIG. 4, a 4-ply bag is illustrated with a first wall 16 comprised of an inner, or first ply 21 and second through fourth plies arranged consecutively therefrom and designated 22 through 24, respectively. The corresponding plies in the opposite wall are designated 21' to 24'. As in FIG. 3, the outermost ply preferably has a moisture impervious polyethylene coating 24(*a*).

A 6-ply bag is illustrated in FIG. 5 having a first wall 16 comprised of an innermost, or first ply 21 and second through sixth plies arranged consecutively therefrom, designated 22 through 26, respectively. The corresponding plies of the opposite, or second wall 18 of the bag are designated 21' through 26', respectively. Preferably, a moisture-proof polyethylene coating 26(*a*) is provided on the exterior surface of the outer ply.

The dunnage bag of the present invention may be fabricated from sheets of Kraft paper by first forming an open ended tube wherein each ply has been folded over, slightly overlapped upon itself, and joined in the overlapped region to form a longitudinal seam. The longitudinal seam for the outermost ply of the dunnage bag is designated 48 in FIG. 1. Preferably, the longitudinal seam of each ply is staggered with respect to the seam of the plies above and below it. Such a longitudinal seam is well known in the art and is dislcosed in the U.S. patent to Evans, U.S. Pat. No. 27,787.

Figure 2:
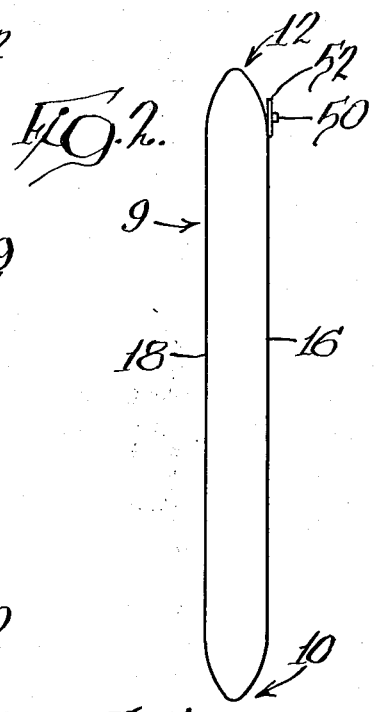
FIG. 2 is an end view of the dunnage bag taken generally along the plane 2—2 of FIG. 1.

A suitable inflation valve device 50 is provided in the wall of the bag, as illustrated in FIGS. 1 and 2, and communicates with the interior of the bladder 14 to permit filling of the bag with pressurized air or other gas. A carrying handle 52 may be provided as an integral part of the housing of the valve 50.

Referring now to the details of the end closure illustrated in FIG. 3, it is seen that the bladder 14 is glued or heat sealed near one end 54 and folded over upon itself between the plies 21 and 21' of the first and second wall. An extension of flap on the inner ply 21 of the first wall 16 is folded over the end of the bag and secured to the exterior surface of the inner ply 21' of the second wall 18, as with adhesive 60. An extension of flap on the second or outer ply 22 of the first wall 16 is folded over the end of the bag secured at 62 to the interior surface of the outer ply 22' of the second wall 18. Preferably, as illustrated in FIG. 3, the flap on the outer ply 22 is further secured to the outer surface of the folded over flap on the inner ply 21. The joint 62 between the outer ply 22 of the first wall and the outer ply 22' of the second wall is preferably made by heat sealing the polyethylene coating 22*a* to the interior surface of the outer ply 22' of the second wall. However, other forms of joint connections may be used such as hot melt adhesives, thermally activated adhesives, latex, or other suitable bonding agents.

The unique end closure described above and illustrated in FIG. 3 involves the creation of a pair of adjacent flaps on the two plies of the first wall 16 which are folded over and then secured to each other, as well as to adjacent plies in the opposite wall 18. This type of structure provides a symmetrical joint system in the second wall 18 and promotes even stress distribution throughout the joint system. Further, it should be noted that both of the plies in the second wall 18 are secured in tension to the flaps to provide strong, positive end closure joints.

The configuration of the end closure illustrated in FIG. 3 can be more efficiently assembled and completed than other types of end closures. Since the flaps of the two plies of the first wall 16 are folded over adjacent to each other, the adhesive can be applied to the underside of both flaps at one gluing station and then both flaps can be folded over together and pressed down upon the first ply 21' of the second wall 18 at that station until the adhesive sets. The fact that other plies need not be interleaved between the two flaps of plies 21 and 22 provides a savings in time and labor.

Referring now to the 4-ply end closure illustrated in FIG. 4, it is seen that the bladder 14 is heat sealed and folded over upon itself in the manner previously described with reference to FIG. 3. The plies of the first wall 16 are seen to be segregated into two pairs of adjacent plies. That is, the flaps on plies 21 and 22 form a pair of adjacent flaps and the flaps on plies 23 and 24 form a pair of adjacent flaps.

The flap on the first ply 21 of the first wall 16 is folded over the end of the bag and secured to the exterior surface of the second ply 22' of the second wall 18. The flap on the second ply 22 of the first wall 16 is folded over the end of the bag and secured to the exterior surface of the folded over flap on the first ply 21. The flap on the third ply 23 of the first wall 16 is folded over the end of the bag and secured to the exterior surface of the third ply 23' of the second wall 18. The flap on the fourth ply 24 of the first wall 16 is folded over the end of the bag and secured to the interior surface of the fourth ply 24' of the second wall 18, and is also preferably secured to the outer surface of the folded over flap on the third ply 23. The folded over flaps are secured in the opposite or second wall 18 by suitable adhesive 60 except that the flap on the fourth ply is preferably secured by a heat seal 62 between the polyethylene coating and the interior surface of the outer ply 24' of the second wall 18.

As with the end closure illustrated in FIG. 3, the extension or flaps on the plies of the first wall are segregated into pairs of adjacent flaps and those pairs are together inserted between plies of the opposite or second wall. With the configuration illustrated in FIG. 4, a substantially symmetrical set of joints is formed in the second wall to promote even stress distribution and provide a strong joint system. Further, three of the four plies that comprise the second wall 18 of the bag are secured to flaps on plies of the first wall to provide a good end closure joint system.

Since the flaps are segregated into folded pairs, the assembly of the end closure can be performed with time and labor savings as compared with other types of end closures. In one step, glue can be applied to the flaps on plies 21 and 22 and the flaps can then be folded over and pressed against the ply 22' of the opposite wall while the glue sets. In a second step, the flaps on plies 23 and 24 can be coated with glue, folded over and held against ply 23' of the second wall as the glue sets. In a third step, the outer ply 24' of the second wall can be heat sealed to the flap of the first wall's outer ply 24.

With the 6-ply bag illustrated in FIG. 5, the flaps of the plies of the first wall are segregated into pairs of adjacent flaps in the same manner as in those embodiments disclosed in FIGS. 3 and 4. Specifically, the flap on the first ply 21 of the first wall 16 is folded over the end of the bag and secured to the exterior surface of the second ply 22' of the second wall 18. The flap on the second ply 22 of the first wall 16 is folded over the end of the bag and secured to the exterior surface of the folded over flap on the first ply 21 of the first wall 16. The flap on the third ply 23 of the first wall 16 is folded over the end of the bag and secured to the exterior surface of the fourth ply 24' of the second wall 18. The flap on the fourth ply 24 of the first wall 16 is folded over the end of the bag and secured to the exterior surface of the folded over flap on third ply 23 of the first wall 16. The flap on the fifth ply 25 of the first wall 16 is folded over the end of the bag and secured to the exterior surface of the fifth ply 25' of the second wall 18. The flap on the sixth ply 26 of the first wall 16 is folded over the end of the bag and secured to the interior surface of the sixth ply 26' of the second wall 18. Preferably, the flap on the sixth ply 26 of the first wall 16 is additionally secured to the exterior surface of the folded over flap on the fifth ply 25 of the first wall 16.

The flaps on the first through fifth plies, 21 through 25, are preferably secured by adhesive 60 and the flap on the outermost, or sixth, ply 26 is preferably secured by heat sealing to the interior surface of the sixth ply 26' of the second wall 18.

The segregated pair structure of secured flaps is seen to provide a fairly symmetrical joint system within the second wall 18 for promoting fairly even stress distribution through the joint system. Further, it should be noted that four of the six plies in the second wall 18 (22', 24', 25' and 26') are secured to a folded over flap from the first wall. This provides a bag that is stronger than the other types of 6-ply bags that have less than four of six plies secured to flaps.

For the same reasons heretofore presented with respect to the construction of the end closures for the two and four ply bags illustrated in FIGS. 3 and 4, the end closure configuration of the 6-ply bag illustrated in FIG. 5 is a more efficiently assembled joint in that a savings in time and labor can be realized because each pair of flaps can be glued, folded and held in place in one step per pair. Thus, only three steps are needed to glue, fold and secure the three pairs of flaps in the 6-ply end closure design. The heat sealing of the joint at the outermost ply is then performed in a fourth step.

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover by the appended claims all such modifications as fall within the scope of the claims.

I claim:

1. A four-ply dunnage bag having a first wall and a second wall and having a folded closure at one end of the bag wherein each ply of the first wall has an extension flap, said first and second walls each having an innermost first ply and second through fourth plies arranged consecutively therefrom, the flap on the first ply of the first wall folded over the end of the bag and secured to the exterior surface of the second ply of the second wall, the flap on the second ply of the first wall folded over the end of the bag and secured to the exterior surface of the folded over flap on the first ply, the flap on the third ply of the first wall folded over the end of the bag and secured to the exterior surface of the third ply of the second wall, and the flap on the fourth ply of the first wall folded over the end of the bag and secured to both the interior surface of the fourth ply of the second wall and the outer surface of the folded over flap on said third ply.

2. A six-ply dunnage bag having a first wall and a second wall and having a folded closure at one end of the bag wherein each ply of the first wall has an extension flap, said first and second walls each having an innermost first ply and second through sixth plies arranged consecutively therefrom, the flap on the first ply of the first wall folded over the end of the bag and secured to the exterior surface of the second ply of the second wall, the flap on the second ply of the first wall folded over the end of the bag and secured to the exterior surface of the folded over flap on the first ply, the flap on the third ply of the first wall folded over the end of the bag and secured to the exterior surface of the fourth ply of the second wall, the flap on the fourth ply of the first wall folded over the end of the bag and secured to the exterior surface of the folded over flap on the third ply, the flap on the fifth ply of the first wall folded over the end of the bag and secured to the exterior surface of the fifth ply of the second wall, and the flap on the sixth ply of the first wall folded over the end of the bag and secured to both the interior surface of the sixth ply of the second wall and the outer surface of the folded over flap on the fifth ply.

* * * * *